US006058535A

United States Patent [19]

Firkins, Jr. et al.

[11] Patent Number: 6,058,535

[45] Date of Patent: May 9, 2000

[54] UNIVERSAL SPORT SEAT

[76] Inventors: Lester D. Firkins, Jr., 8903 Aria Dr., Louisville, Ky. 40219; Jerry B. Hazelip, 139 Arroyo Trail, Louisville, Ky. 40229

[21] Appl. No.: 09/211,236

[22] Filed: Dec. 14, 1998

[51] Int. Cl.[7] ..... A47C 27/16; A47C 27/14

[52] U.S. Cl. ..... 5/653; 5/420; 297/219.1

[58] Field of Search ..... 5/653, 420, 655.9, 5/656, 657; 29/91, 91.1; 297/219.1; 112/475.08

[56] References Cited

U.S. PATENT DOCUMENTS

| | | | |
|---|---|---|---|
| 2,001,252 | 5/1935 | Johnson . | |
| 2,156,629 | 5/1939 | Hutchison . | |
| 2,457,978 | 1/1949 | Curran . | |
| 2,675,807 | 4/1954 | Pursel . | |
| 2,738,834 | 3/1956 | Jaffe et al. | 5/420 |
| 2,834,970 | 5/1958 | Nappe | 5/420 |
| 2,865,433 | 12/1958 | Warner . | |
| 3,061,844 | 11/1962 | Coursey . | |
| 3,069,203 | 12/1962 | Propus . | |
| 3,259,925 | 7/1966 | Tilles . | |
| 3,603,639 | 9/1971 | Wilson . | |
| 3,902,753 | 9/1975 | Wilson . | |
| 3,903,346 | 9/1975 | DeLeon et al. . | |
| 4,097,944 | 7/1978 | Yulish . | |
| 4,169,921 | 10/1979 | Moss . | |
| 4,190,918 | 3/1980 | Harvell . | |
| 4,386,983 | 6/1983 | Hipchen et al. . | |
| 4,411,949 | 10/1983 | Snider et al. . | |
| 4,630,863 | 12/1986 | Roberts . | |
| 4,658,452 | 4/1987 | Brockhaus . | |
| 4,679,848 | 7/1987 | Spierings . | |
| 4,680,822 | 7/1987 | Fujino et al. . | |
| 4,824,171 | 4/1989 | Hollingsworth . | |
| 4,969,683 | 11/1990 | Wallace et al. . | |
| 5,100,203 | 3/1992 | Novak . | |
| 5,388,295 | 2/1995 | Sarkozi | 5/420 |
| 5,724,917 | 3/1998 | Dodson et al. | 5/420 |

*Primary Examiner*—Alexander Grosz
*Attorney, Agent, or Firm*—Stites & Harbison; Joan L. Simunic; Vance A. Smith

[57] ABSTRACT

The present invention provides an insulating, heat-reflective pad made from several thin slats of insulating material which are held between a breathable top sheet of material and a water resistant bottom sheet of material. The sheets of material are joined so as to create pockets which hold insulating slats made from a polyisocyanurate foam composite. The pad can be folded along the stitched seams into a small easily portable bundle.

5 Claims, 3 Drawing Sheets

UNIVERSAL SPORT SEAT

BACKGROUND OF THE INVENTION

This invention is related to a portable insulated pad that includes a plurality of heat-reflective, insulating slats, a breathable top sheet, and a water resistant bottom sheet. The pad is designed to protect the user from cold or wet surfaces, to provide the user with a warm seat, and to allow the pad to be bundled, making it easy to transport.

Seats made from slats or thin strips of material are known. For example, U.S. Pat. No. 2,001,252, issued to Johnson, teaches a portable, foldable chair consisting of a plurality of slats, preferably made of wood, with the slats held in place by strips of fabric stitched together to form individual pockets for each slat. The chair can be folded and rolled into a bundle for transporting. Other materials, such as moldable thermoplastic materials and various fabrics have also been used to make strips which are then joined to form seats. If the slats or strips of material are thin and relatively narrow, the seat can be rolled into a bundle or folded into a relatively small unit for easy transport. Slats made from wood, thermoplastic materials, or fabric, provide some protection against uncomfortable surfaces, but do not reflect body heat back to the user.

Pads designed for sporting activities have used heat-reflective, insulating materials. U.S. Pat. No. 3,259,925, issued to Tilles, and U.S. Pat. No. 3,603,639, issued to Wilson, teach using foamed polystyrene as a heat reflector and insulator in cushions. However, in both the '925 patent and the '639 patent, the resultant cushions are not thin, making them difficult to fold into small bundles.

SUMMARY OF THE INVENTION

The present invention provides an insulating, heat-reflective pad made from several thin slats of insulating material which are held between a breathable top sheet of material and a water resistant bottom sheet of material. The sheets of material are joined so as to create pockets which hold the insulating slats. The slats are less than about 1.0" thick and are made from a polyisocyanurate foam composite. The polyisocyanurate foam composite has been found to have superior body heat reflecting properties relative to other slat materials and also provides protection from cold surfaces. The pad can be folded along the stitched seams into a small easily portable bundle.

DETAILED DESCRIPTION OF THE INVENTION

Figure 1:
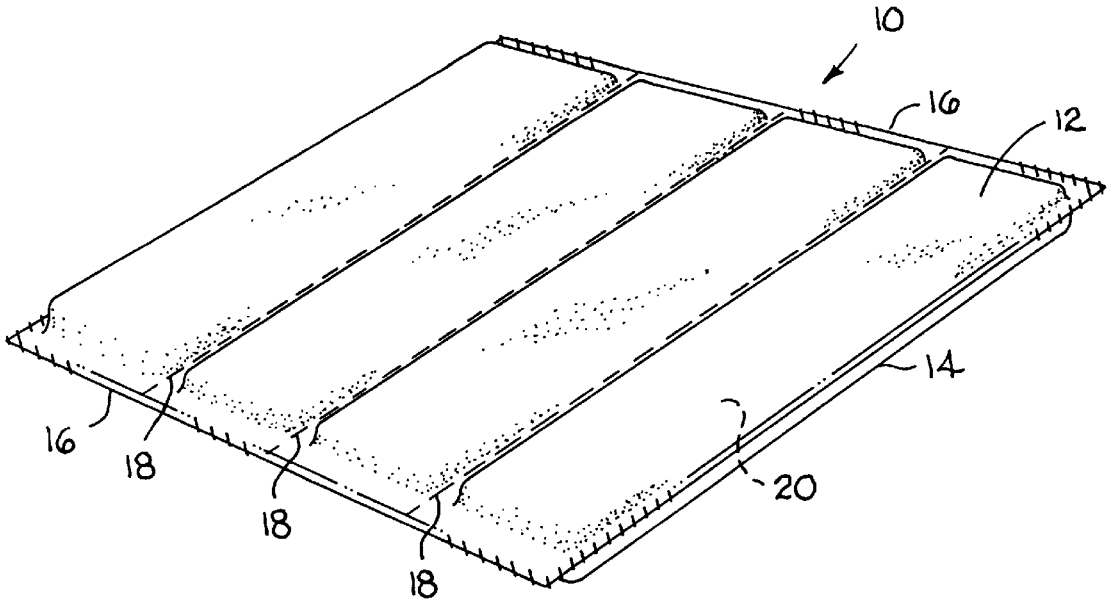
FIG. 1 is a perspective view of a sport pad made in accordance with the present invention.

FIG. 1 is a perspective view of a sport pad made in accordance with the present invention. The four-slat pad, defining an essentially square shape, depicted in FIG. 1 and generally noted by the character numeral 10 is selected solely for purposes of illustrating the invention. Other pads may utilize the inventive features described herein as well, for example, the pads may have a different number of slats or a different shape.

Figure 2:
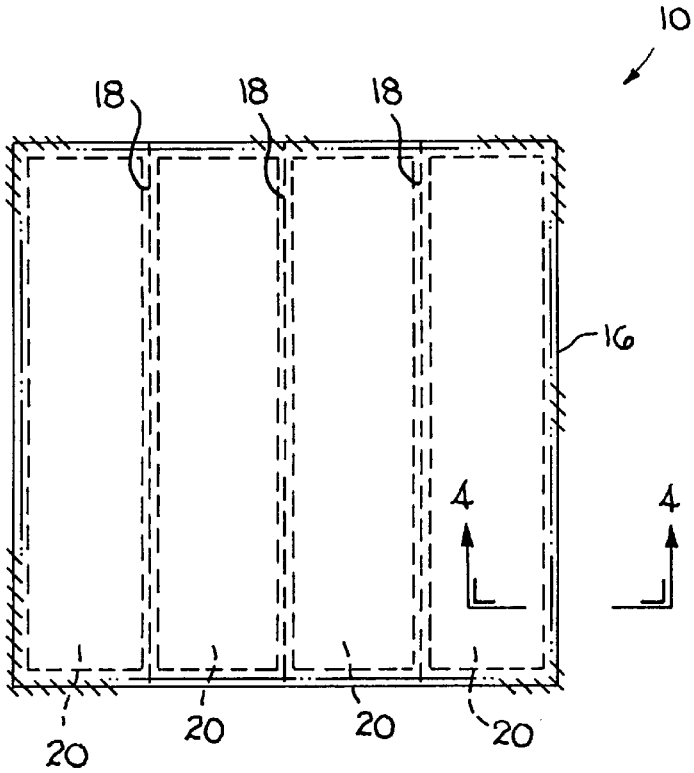
FIG. 2 is a top view of the sport pad of FIG. 1.
Figure 3:
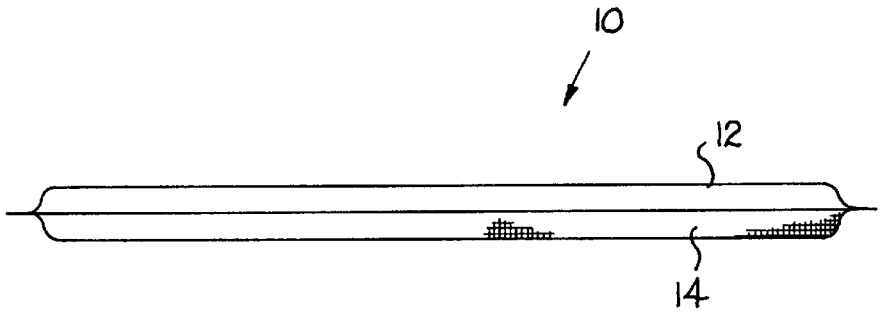
FIG. 3 is a side view of the sport pad of FIG. 1.

The pad 10 of FIGS. 1, 2, and 3, has as major components a top sheet of material 12, a bottom sheet of material 14, and a plurality of slats of insulating core material 20. The top sheet 12, having a periphery 16, can be any woven, non-woven, or knitted material that has interstices, for example, broadcloth cotton blend, canvas, nylon fabric, Spandex®, or other materials having interstices. The interstices make the material breathable, and provide a way for body heat to be transferred from the user to the slats 20, and for heat to be reflected from the slats 20 back to the user. The bottom sheet 14 can be any water resistant or water impervious material, such as vinyl, nylon, Naugahyde®, or like materials. The bottom sheet 14 preferably is non-porous, to aid in water resistance and to minimize heat transfer between the pad 10 and its surroundings.

The top sheet 12 is joined to the bottom sheet 14 along the periphery 16. A series of parallel seams 18, seen more clearly in FIG. 2, also joins the top sheet 12 to the bottom sheet 14, creating pockets 40 to encase each slat 20 individually. The top and bottom sheets 12, 14 can be joined using any suitable means, such as stitches, glue, hot-melt adhesive, or any combination thereof.

Figure 4:
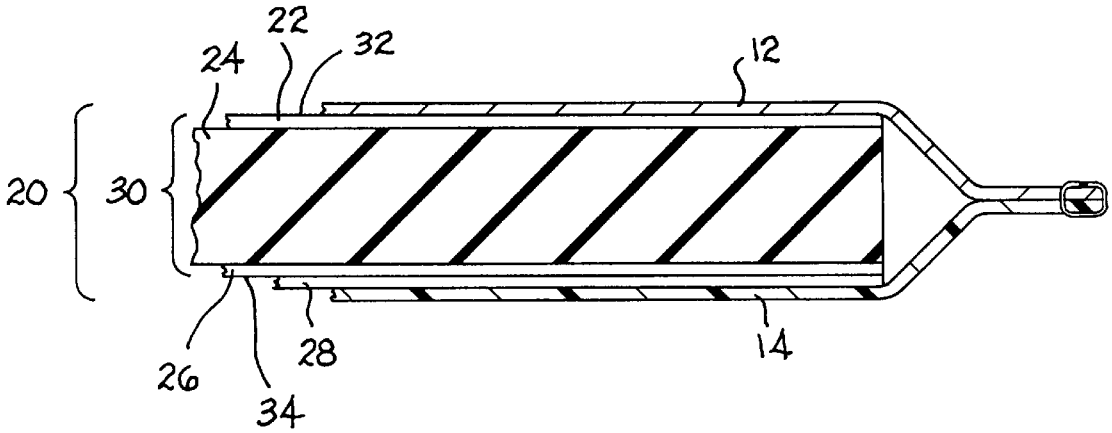
FIG. 4 is a cross-sectional view taken along line 4—4 of FIG. 2; and, FIG. 5 is a view of a sport pad being assembled.

As seen in FIG. 4, the core material slats 20 are semi-rigid layered structures which include a first facing 22, a foam core 24, a second facing 26, and a reinforcing layer 28. The slats 20 are sized to fit snuggly within the pockets 40 created between the top and bottom sheets 12, 14, and are positioned between the sheets 12, 14, with the first facing 22 adjacent to the top sheet 12, and the reinforcing layer 28 adjacent to the bottom sheet 14. The foam core 24 is sandwiched between and laminated to the first and second facings 22, 26, forming a facing 22/foam 24/facing 26 composite 30. The composite 30, having exterior surfaces 32, 34, should have a total thickness of from about 0.2" to about 1.0". The reinforcing layer 28 is attached to the exterior surface 34.

The first and second facings 22, 26 preferably are moisture vapor impermeable sheets, having at least one layer of aluminum foil. The foil can further be laminated to a sheet of material that is suitable for use in building panels, such as kraft paper, asphalt impregnated felts, or laminates thereof. The foam core 24 is a polyisocyanurate-based foam, such as described in U.S. Pat. Nos. 3,903,346, 4,169,921, and 4,411,949, incorporated herein by reference. The foam core 24 can further include reinforcement materials, such as a quantity of glass fibers, as described in U.S. Pat. No. 4,386,983, incorporated herein by reference. The facings 22, 26 and foam core 24 are preferably purchased as a composite, such as the facing/foam/facing material sold by The Celotex Corp., 4010 Boy Scout Blvd., Tampa, Fla. 33607, under the brand name Tuff R® Non-Reflective Insulating Sheathing, having a thickness of about ½" and an R-value of about 3.0. The reinforcing layer 28 can be any thin material, having a high tensile strength, such as duct tape, aluminum tape, plastic sheeting, or a combination thereof. The layer 28 provides support to the relatively brittle composite 30, keeping the composite 30 from cracking when weight is applied, such as when a person sits on the pad.

EXAMPLE 1

In a preferred embodiment, the pad 10 is made having the top sheet 12 made of broadcloth cotton fabric; the bottom sheet 14 made of vinyl; and the slats 20 made of Tuff R® Non-Reflective Insulating Sheathing (polyisocyanurate-based foam sheathing), having a thickness of about ½", reinforced with a layer 28 of duct tape. The top sheet 12 is attached to the bottom sheet 14 with stitched seams.

The materials used in the core material slats 20 must reflect body heat back to the user, in addition to insulating the user from cold surfaces. In particular, it has been found that slats 20 made of polyisocyanurate-based foam 24 is superior to other foamed materials and other insulating materials with respect to body heat reflection, based on a two minute body heating test. The body heat reflecting properties are determined by having an adult male sit on the top sheet 12 of the pad 10 for two minutes, and then measuring the temperature of the top sheet 12.

EXAMPLE 2

Using the pad 10 of Example 1, an adult male sits on the pad 10 for two minutes, and the temperature of the top sheet 12 is measured using a strip thermometer, such as the FeverScan Ultra®, manufactured by Hallerest Products, 1820 Pickwick Lane, Glenview, Ill., 60025. The top sheet temperature is from about 96° F. to about 101° F.

EXAMPLE 3

The pad 10 is made as in Example 1, except that the slats 20 are made of about ½" thick polystyrene. The top sheet temperature, using the two minute body heat test, is less than about 94° F.

EXAMPLE 4

The pad 10 is made as in Example 1, except that the slats 20 are made of about ½" thick wood. The top sheet temperature, using the two minute body heat test, is less than about 94° F.

Figure 5:
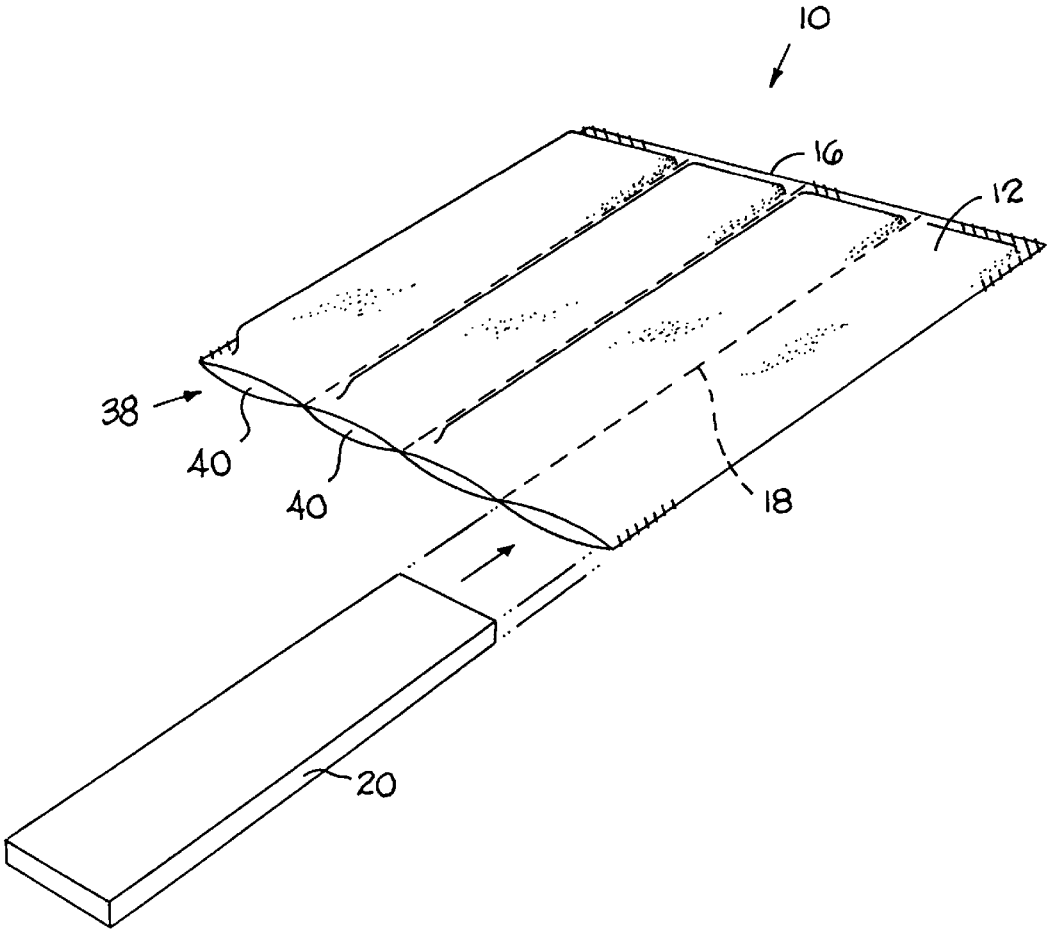

As shown in FIG. 5, the pad 10 is made by cutting the top sheet 12 and bottom sheet 14 to the size and shape desired for the finished product. The top and bottom sheets 12, 14, are superimposed, and attached along the periphery 16, leaving an open section 38. A series of essentially parallel seams 18 are then made across the sheets 12, 14, creating a series of pockets 40, such that each pocket 40 has three closed sides and one open side. Preferably, the parallel seams 18 are approximately equally spaced. The core material slats 20 are prepared separately, as described below, and are inserted into the pockets 40, then the opening 38 is sealed closed, for example, by stitching.

The slats 20 are prepared from the first facing 22/foam layer 24/second facing 26 composite, which is preferably purchased as a composite 30. Alternatively, the composite 30 can be made by laminating the layers 22, 24, 26 together. The composite 30 is preferably painted black on the exterior surface 32, and a reinforcing layer 28 is attached to the exterior surface 34. The reinforced composite is cut into slats 20 that will snuggly fit within the pockets 40. Alternatively, the composite 30 can be cut into slats, and then the reinforcing layer 28, cut to fit each slat, can be attached. Attaching the reinforcing layer 28 before cutting the composite 30 is less labor intensive, but does not affect the finished product.

EXAMPLE 5

The pad 10 is made using the materials of Example 1. The top and bottom sheets 12, 14, are cut approximately into squares with sides of about 15". The top and bottom sheets 12, 14, are superimposed, and are stitched on three sides along the periphery 16. Parallel seams 18 are stitched across the top and bottom sheets 12, 14, with the seams being separated by about 3½". The composite 30, Tuff R® Non-Reflective Insulating Sheathing having black exterior surfaces 32, 34, is reinforced on surface 34 with a layer 28 of duct tape, and is then cut into slats of approximately 3⅜"×14"×½". One slat 20 is inserted into each pocket 40. After all slats are inserted, the opening 38 is stitched closed.

It will be obvious to those skilled in the art that modifications may be made to the embodiments described above without departing from the scope of the present invention.

What is claimed is:

1. A sport pad which can be easily folded into a portable bundle comprising:

a top sheet selected from the group of woven, non-woven, and knitted materials having interstices, and having a periphery;

a bottom sheet, attached to said top sheet along the periphery and by a plurality of seams, so as to create a series of pockets between said top sheet and said bottom sheet; and a plurality of polyisocyanurate-based foam slats, positioned between said top sheet and said bottom sheet, and encased within the pockets, wherein each of said foam slats is a layered structure, having two layers of moisture vapor impermeable material with a polyisocyanurate-based foam layer sandwiched between said vapor impermeable layers, and wherein each of said foam slats has a thickness of from about 0.2" to about 1.0".

2. A sport pad as recited in claim 1, wherein said bottom sheet is a water resistant material.

3. A sport pad as recited in claim 1, wherein said polyisocyanurate-based foam slat, having a first and a second exterior surface, further includes a reinforcing material layer, attached to said second surface.

4. A sport pad as recited in claim 1, wherein said top sheet is attached to said bottom sheet by stitching.

5. A method for making a sport pad which can be easily folded into a portable bundle, comprising the steps of:

providing a bottom sheet;

positioning a top sheet selected from the group of woven, non-woven, and knitted materials having interstices, and having a periphery, on said bottom sheet;

attaching said top sheet to said bottom sheet, along the periphery and by making a plurality of essentially parallel seams across said top and bottom sheets, so as to create a plurality of pockets, leaving an opening on each pocket;

inserting a polyisocyanurate-based foam slat in each said pocket, each of said slats being a layered structure, having two layers of moisture vapor impermeable material with a polyisocyanurate-based foam layer sandwiched between said vapor impermeable layers, and wherein each of said foam slats has a thickness of from about 0.2" to about 1.0"; and sealing said opening, so as to encase said slat in said pocket.

* * * * *